US007451877B2

(12) United States Patent
Koga et al.

(10) Patent No.: US 7,451,877 B2
(45) Date of Patent: Nov. 18, 2008

(54) REFILL CASE

(75) Inventors: Tadayasu Koga, Kobe (JP); Chiaki Kamimura, Ibaraki (JP); Tsugio Arai, Ibaraki (JP)

(73) Assignees: Yoshino Kogyosho Co., Ltd., Tokyo (JP); The Procter & Gamble Company, Cincinnati, OH (US)

( * ) Notice: Subject to any disclaimer, the term of this patent is extended or adjusted under 35 U.S.C. 154(b) by 268 days.

(21) Appl. No.: 10/549,516

(22) PCT Filed: Nov. 4, 2004

(86) PCT No.: PCT/JP2004/016686

§ 371 (c)(1),
(2), (4) Date: Jan. 3, 2006

(87) PCT Pub. No.: WO2005/048767

PCT Pub. Date: Jun. 2, 2005

(65) Prior Publication Data

US 2006/0196804 A1 Sep. 7, 2006

(30) Foreign Application Priority Data

Nov. 19, 2003 (JP) ..... 2003-389371

(51) Int. Cl.
*B65D 69/00* (2006.01)
*B65D 53/00* (2006.01)

(52) U.S. Cl. ..... 206/581; 215/341; 215/345

(58) Field of Classification Search ..... 206/581, 206/823; 220/295, 304, 849, 367.1, 372; 132/293, 305; 215/341, 345, 350, 309
See application file for complete search history.

(56) References Cited

U.S. PATENT DOCUMENTS

| | | | | |
|---|---|---|---|---|
| 3,311,248 | A * | 3/1967 | Marchant | 215/13.1 |
| 4,310,101 | A * | 1/1982 | Sekine | 215/330 |
| 5,896,866 | A * | 4/1999 | Quennessen | 132/293 |
| 5,938,016 | A * | 8/1999 | Erdtmann | 206/221 |
| 6,047,710 | A * | 4/2000 | Irving et al. | 132/293 |
| 6,336,460 | B2 * | 1/2002 | Yuhara | 132/295 |
| 6,923,335 | B2 * | 8/2005 | Fujita et al. | 220/291 |
| 6,988,630 | B2 * | 1/2006 | Matsumoto | 220/254.4 |

FOREIGN PATENT DOCUMENTS

| | | |
|---|---|---|
| JP | A 11-276240 | 10/1999 |
| JP | A 2000-125928 | 5/2000 |
| JP | A 2003-210245 | 7/2003 |

* cited by examiner

*Primary Examiner*—Mickey Yu
*Assistant Examiner*—Melissa L Lalli
(74) *Attorney, Agent, or Firm*—Oliff & Berridge PLC

(57) ABSTRACT

A refill case that includes a middle plate, the middle plate has a bottomed short cylinder shape that contains a cosmetic item and an outward brim along the periphery, a case body that accepts and keeps the middle plate, and a cap that is fitted around the case body detachably in screw engagement. The refill case also includes a ring-shaped gasket made of a soft, elastic material used to seal the middle plate through tight contact of the brim, and a butting wall disposed on either one of the case body or the cap to butt against the other one at a position in which screw engagement of the cap is complete and in which soft contact deformation of the gasket is controlled within a range of elastic deformation. The gasket is fitted to the cap in an undetachable manner but having play relative to the roof.

10 Claims, 4 Drawing Sheets

REFILL CASE

TECHNICAL FIELD

This invention relates to a refill case in which to put a replaceable middle plate containing a cosmetic material.

BACKGROUND ART

Cosmetic materials in the shape of powder or solid are put in middle plates, and each middle plate is then kept stored in a compact case. This middle plate containing a cosmetic item is removable from the compact case. Since compact cases of such a type are highly economical and convenient, these compact cases are in heavy usage.

If the compact cases of the type having a removable middle plate are to be used effectively, it is advantageous to utilize a refill case for exclusive use, in which to keep a replaceable middle plate.

There is a prior-art refill case of this type, wherein the lid and the case body are fitted to each other in a lockable manner and wherein either the lid or the case body is provided with a finger-positioning mark having a dent (See Patent Document 1).

The replaceable middle plate need be sealed to prevent the cosmetic in the middle plate from drying or absorbing moisture and to prevent evaporation of volatile components, such as aromatic substances, in the cosmetic. There is a prior-art middle plate wherein the opening is sealed with a sealing film that is easily releasable (See Patent Document 2).

| | |
|---|---|
| [Patent Document 1] | P1999-276240 |
| [Patent Document 2] | P2003-210245 |

DISCLOSURE OF THE INVENTION

However, in the case of conventional art disclosed in Patent Document 1, the refill case in itself has no ability to seal the middle plate that has been put therein. Thus, the problem arises from the fact that the middle plate to be put in the refill case is limited to the one which has been sealed as disclosed in Patent Document 2.

In the conventional art in which Patent Documents 1 and 2 are combined, it becomes impossible to restore the middle plate to the sealed state once the middle plate is opened by peeling off the sealing film. Therefore, another problem is that after the middle plate has been opened, there is no utility for the refill case of Patent Document 1, thus making such a refill case economically inefficient.

Furthermore, once the middle plate has been opened, it cannot be sealed again unless it is fitted in the compact case. Therefore, if the user wants to change a cosmetic item to another one, there is no alternative other than finishing up the cosmetic or discarding the one now in use together with the middle plate. Users have been dissatisfied with quite an inconvenient situation in which they cannot fully utilize the expensive cosmetic remaining in the middle plate.

This invention has been made to solve the problems observed in the above-described conventional art. The technical problem of this invention is to keep the middle plate sealed stably and securely. The objects of this invention are to maintain safely the quality of the cosmetic that is put in the middle plate with no regard to the sealing of the middle plate and to make the middle plate replaceable at the user's own discretion.

The means of carrying out the invention of claim 1 to solve the above-described problems is a refill case comprising:

that a middle plate is in the shape of a bottomed short cylinder containing a cosmetic item and having outward brim along the upper periphery of said plate;

that a case body accepts and keeps said middle plate in a storage cylinder under the condition that said brim sits on the flat top rim of this storage cylinder; and that a cap is fitted around said case body detachably in screw engagement, and is used to seal said middle plate through tight contact of said brim with a ring-shaped gasket made of a soft, elastic material, said gasket being embraced by the underside of roof and fitted thereto in an undetachable manner but in a state having play relative to said roof, wherein a butting wall is disposed on either one of the case body or the cap so as to butt against the other one at a position in which screw engagement of said cap with the case body is complete and in which soft contact deformation of the gasket is controlled within a range of elastic deformation.

In the invention of claim 1, the case body accepts and keeps the middle plate in its storage space. As the cap is screwed on the case body, the gasket fitted to the cap comes in soft, tight contact with the brim of the middle plate. Consequently, the middle plate is sealed by the cap, and the sealed condition is maintained.

Thus, it is possible for the refill case of this invention to accept and keep the middle plate therein and to seal the middle plate, with no regard to a new product or a used one. Therefore, this refill case can be used as a storage case for a replaceable middle plate. The user may select any desired middle plate, carry it in this refill case, and replace it with the one inside the compact case.

The gasket is fitted to the cap, not in firm fitting by means of an adhesive, etc., but in a configuration that the gasket is embraced by the cap in a state having play relative to the cap. The gasket in this state does not fall off from the place where it carries out a sealing function, but is capable of shifting its position.

Therefore, the gasket is twisted and deformed with the relative turns of the cap at the time when the cap is screwed on the case body. However, since the gasket is fitted to the cap in a manner capable of shifting its position, it turns out that torsional deformation of the gasket, which is about to occur, immediately disappears due to the shift caused by the elastic force of the gasket.

As described above, the gasket is prevented from getting damaged by torsional deformation at the time of screw engagement of the cap with the case body. Since the gasket gets no damage to its sealing function even on the occasion of torsional deformation, the gasket performs its sealing function stably and reliably.

In addition, a butting wall is disposed between the case body and the cap and is used in such a way that the soft contact deformation of the gasket is controlled within a range of elastic deformation at the position where screw engagement of the cap with the case body is complete. Under this configuration, the cap is prevented from being fastened so overly as to deform the gasket beyond the permissible range of elastic deformation.

The invention of claim 2 includes the invention of claim 1, and comprises that rubber is used as a soft, elastic material for molding the gasket.

Torsional deformation tends to be created in rubber gasket due to the turns of the cap relative to the case body. However, the invention of claim 2 enables the rubber gasket to be utilized without causing any torsional deformation. Thus, the high sealing function of the rubber gasket is effectively attained.

The invention of claim 3 includes the invention of claim 1 or 2, and comprises that the case body has a double wall structure in which the storage cylinder is folded at the top flat rim to form the outward screw cylinder for use in the screw engagement with the cap, and that a foot portion is disposed at the lower end of this screw cylinder.

In the invention of claim 3, the case body is divided into a portion in which the middle plate is set and held and a portion on which the cap is screwed. Under this configuration, both portions can be connected reasonably. The cap is fitted around the screw cylinder, and in addition, the foot portion is disposed at the lower end of the screw cylinder to give it a "seat function." The storage cylinder is protected against direct butting thereon, thus reducing the opportunities of impact from outside on the middle plate kept inside the storage cylinder.

The invention of claim 4 includes the invention of claim 1, 2, or 3, and comprises that the butting wall in the short cylindrical shape hangs down from underside of the cap and butts against the top brim surface of the middle plate which has been put and kept in the case body.

In the invention of claim 4, the cap is equipped with the butting wall. There is no inconvenience caused by the butting wall disposed on the case body, such as a case where the butting wall stands in the way of the middle plate, which is put and kept in, or taken out of, the case body. Since the butting wall can be located near the gasket, the wall controls the gasket precisely and reliably. The gasket comes in soft, tight contact with the brim of the middle plate that has been put inside the case body, and additionally, the butting wall butts against the brim. Because of this butting, the soft contact of the gasket with the brim is always kept constant, and thus, the gasket is controlled precisely by the butting wall.

The invention of claim 5 includes the invention of claim 1, 2, or 3, and comprises that the butting wall disposed on the cap butts against the top flat rim of the case body In the invention of claim 5, it is possible to reduce the width of the middle plate brim. Since the strong clamping force of the cap does not act on the middle plate, the latter can be more safely kept in the case body than when the force acts on the brim.

The invention of claim 6 includes the invention of claim 1, 2, 3, 4, or 5, and comprises that the gasket consists of a ring-shaped main gasket portion, which elastically comes in tight contact with the brim, and a ring-shaped fitting portion, which is disposed on the inward side of the main gasket portion and is used for the fitting to the cap and that the gasket is fitted to the cap in an undetachable manner but in a state having play relative to the roof, while the fitting portion is disposed between the roof and a gland fixed to the roof.

In the invention of claim 6, the gasket is fitted to the cap in a state having play in the radial direction so that the fitting portion distinguished from the main gasket portion is disposed between the cap roof and the gland, which is a member exclusively used for fitting. Under this configuration, the gasket is embraced by the cap, and is fitted thereto in a manner displaceable in both the circumferential and radial directions, thus preventing the gasket from falling into the state of torsional deformation.

The gland is disposed at a position facing the fitting portion of the gasket, and is away from the main gasket portion. Therefore, it is easy for the main gasket portion to fulfill its sealing function without trouble and without being affected by the gland.

EFFECTS OF THE INVENTION

This invention having the above-described configuration has the following effects:

In the invention of claim 1, the user can carry a middle plate in the sealed state with no regard to a new or used one. Thus, the user away from home is free to replace the middle plate inside the compact case with any desired middle plate in the refill case. This situation makes it possible for the user to utilize an expensive compact case more effectively.

The gasket is fitted to the cap under the configuration that the gasket is embraced by the cap in a state having play. Therefore, the gasket is capable of shifting its position relative to the cap. Even if the torsional deformation might occur in the gasket when the cap is screwed on the case body, it would disappear immediately because this shift in position is caused by the elastic nature of the gasket. Thus, the sealing function of the gasket can be performed stably because the gasket is free from any inconvenient deterioration caused by the torsional deformation.

Furthermore, the butting wall is disposed between the case body and the cap, and prevents the cap from being screwed overly and causing too much gasket deformation that exceeds the range of elastic deformation. Because of this action of the butting wall, the gasket never gets excessive permanent deformation or damage enough to reduce the sealing function.

In the invention of claim 2, the rubber is capable of performing its high sealing function.

In the invention of claim 3, it has become reasonably possible that the case body comprises a portion for receiving and retaining the middle plate and the other portion which is brought to screw engagement with the cap. Due to this configuration, the case body can be molded easily. Since the screw cylinder has a foot portion, there can be fewer opportunities for the middle plate to be affected by the impact from outside. Thus, the cosmetic item inside the middle plate can be safely protected.

In the invention of claim 4, the butting wall is disposed on the cap. There occurs no inconvenience that this butting wall stands in the way of the middle plate, when the middle plate is put in, or taken out of, the case body. Rather, the butting wall under this configuration prevents the middle plate from inefficient handling. Since the butting wall may be located near the gasket, the gasket control is performed precisely and reliably, and the gasket is safely protected. The gasket comes in tight, soft contact with the brim of the middle plate contained in the case body, and at the same time, the butting wall butts against the brim. In this way, the butting wall always controls the gasket so precisely as to determine the extent of the control easily.

In the invention of claim 5, it is possible to reduce the width of the middle plate brim and to simplify the structure of the middle plate. Under this configuration, no strong clamping force of the cap is applied onto the middle plate. Therefore, the middle plate would have no torsional deformation, or there would be no inconvenience of breakage in the solid cosmetic item inside the middle plate, thus enabling the cosmetic to be put and kept safely in the middle plate.

In the invention of claim 6, the gasket is fitted to the cap in a state having play in the radial direction, and the fitting portion, distinguished from the main gasket portion, is embraced by the cap. Under this configuration, the gasket can be fitted to the cap in a manner capable of shifting its position in both the circumferential and radial directions. In this state, the gasket is prevented from falling into the state of torsional deformation.

PREFERRED EMBODIMENTS OF THE INVENTION

Figure 4:
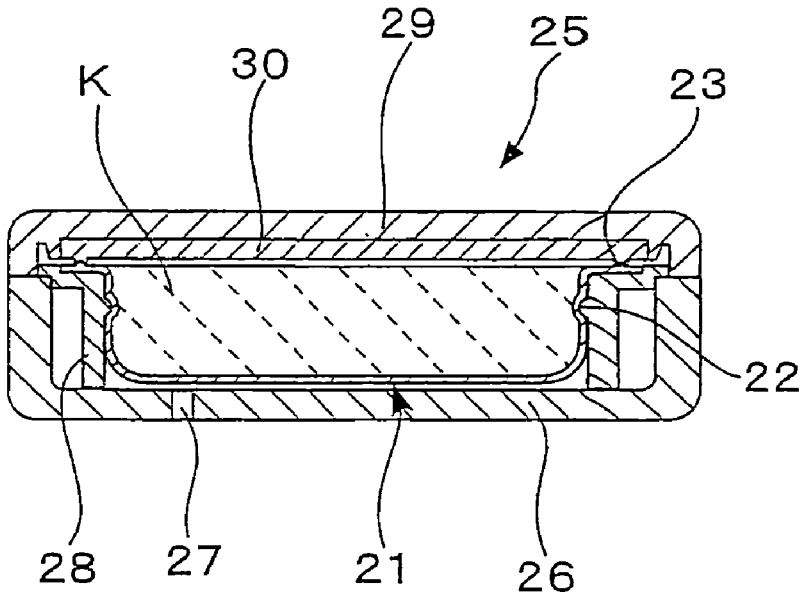
FIG. 4 is a vertical section of the compact case showing the middle plate fitted therein.

This invention is further described with respect to preferred embodiments, now referring to the drawings. As shown in FIG. 4, this invention refers to a refill case 1 in which to carry a replaceable middle plate 21 that contains a cosmetic material K. The middle plate 21 made of a metal sheet is tight fit in the refill case 1, and is detachably built into the compact case 25.

The compact case 25 (See FIG. 4) in which to fit the middle plate 21 comprises a main body 26 in a bottomed cylindrical shape, a lid 29 which is connected by hinges to this main body 26 at respective rear sides so that the lid 29 turns relative to the main body 26 to open or close the compact case 25, and an inner frame 28 which is disposed inside the main body 26 and forms the space accepting and keeping the middle plate 21.

A poking hole 27 is open in the bottom of the main body 26 of the compact case 25. A rod (not shown) is inserted into the hole to push up the built-in middle plate 21 so that the plate 21 can be taken out of the compact case 25. A gasket 30 is fitted under the lid 29 and is used to make soft, tight contact with the brim 23 of the middle plate 21 and to seal this middle plate 21 while it is kept inside the compact case 25.

When this middle plate 21 is fitted to the compact case 25, the bottomed cylindrical body of the middle plate 21 is inserted into the inner frame 28. At that time, the brim 23 is supported by the top surface of the inner frame 28. Under this condition, a lock-operating part provided on the inner wall of the inner frame 28 is fitted in a locking groove 22 disposed in the outer body wall of the middle plate 21.

The middle plate 21 is removed from the compact case 25 by opening the lid 29, inserting a rod into the poking hole, pushing up the bottom of the middle plate 21 with the rod to force the locking groove 22 to be relieved from the lock, and taking out the middle plate 21.

Figure 1:
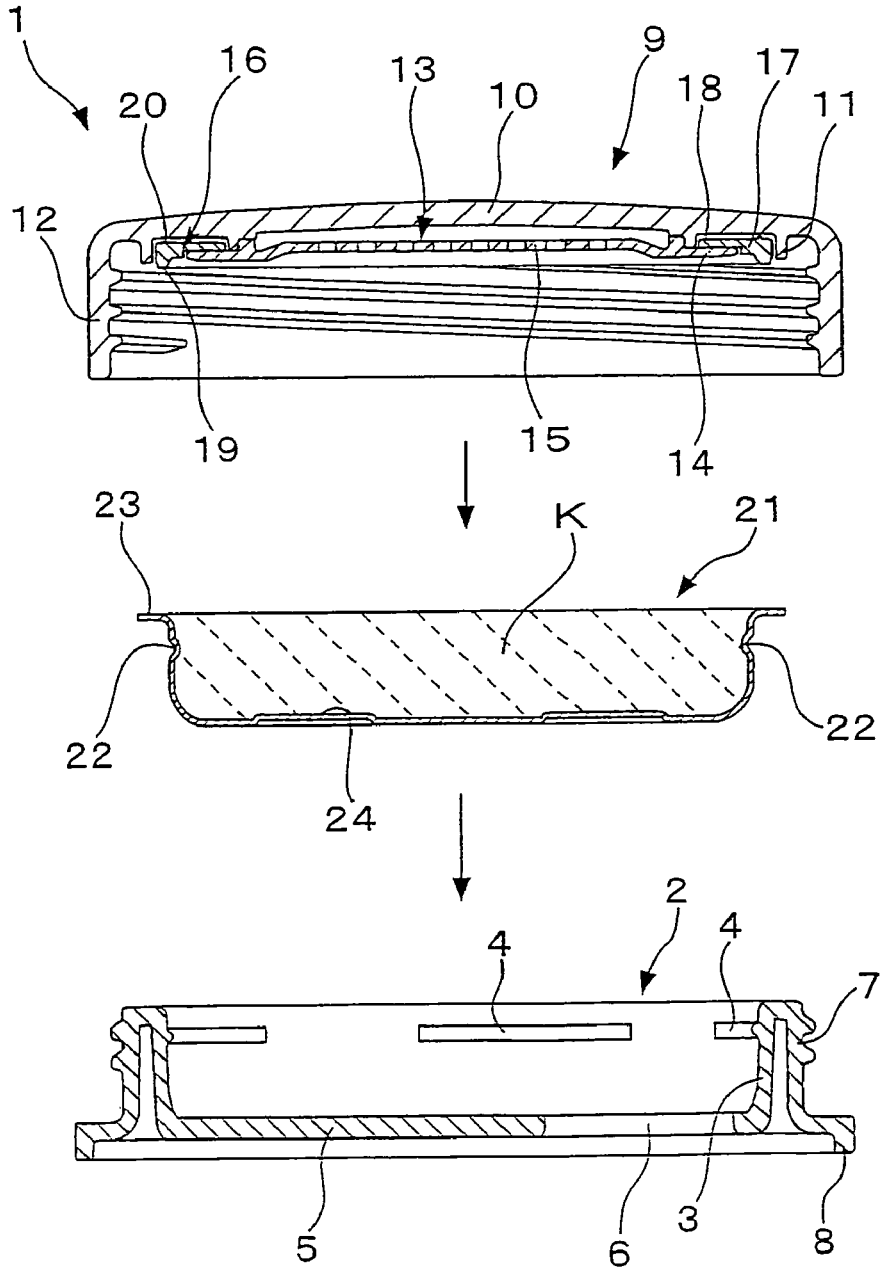
FIG. 1 is an exploded vertical section of the refill case in one embodiment of this invention.

FIG. 1 shows the refill case in one embodiment of this invention, which is used to keep the middle plate 21 detachably in the sealed state so that the middle plate 21 can be put in, and taken out of, the above-described compact case 25. The refill case 1 comprises the case body 2 for putting and keeping the middle plate 21 therein, and the cap 9 that is screwed detachably on the case body 2 to seal the middle plate 21.

The case body 2 comprises a storage cylinder 3, which has bottom plate 5 and receives the middle plate 21 by fitting the cylindrical body into this storage cylinder 3; a screw cylinder 7 having screw thread notched on the outer wall and forming a double-cylinder structure by connecting the storage cylinder 3 with the screw cylinder 7 at the top flat rim; and a foot portion 8 which is disposed at the lower end of the screw cylinder 7 by way of a flange in the shape of an outward brim to form a "seat."

The storage cylinder 3 is provided with intermittent locking ridges 4 in the shape of horizontal ridge segments. These ridges 4 come in locking engagement with the locking groove 22 in the wall of the middle plate 21 at a place where the middle plate 21 has been completely fitted, with its brim 23 sitting on the top flat rim of the case body 2. The bottom plate 5 has a window hole 6 large enough to afford a finger tip to be inserted, at a place near the periphery.

The brim 23 of the middle plate 21 stably sits on the top flat rim of the case body 2, i.e., the top surface of the portion connecting between the edges of the storage cylinder 3 and the screw cylinder 7. The lower end of the foot portion 8 is located at a level lower than the underside of the bottom plate 5 so that the bottom plate 5 would never butt against the table top when the case body 2 is put on the table.

The cap has the shape of a roofed cylinder. Cylindrical side wall 12 hangs down from the periphery of the roof 10 having a flat disc shape. Screw thread is notched on the inner wall so that the screw thread is engaged with the screw cylinder 7 of the case body 2. A butting wall 11 in the shape of a short cylinder hangs down from the underside of the roof 10 near the peripheral part of the roof 10. A gland 13 and a gasket 16 are fitted to the underside of the roof 10.

The gland 13 comprises a support 14 in the peripheral area, where the gasket 16 is embraced by the cap 9 and fitted thereto in the state having play with the help of this support 14, and a drop-preventing portion 15 in the central area, where many small holes are open in this portion. The gland 13 is fitted to the roof 10 by ultrasonic adhesion (See FIG. 2) or by undercut engagement (See FIG. 3) in the state that there is a space between the underside of the roof 10 on one hand and the drop-preventing portion 15 and the support 14 on the other hand.

The entirely ring-shaped rubber gasket 16 is divided into a main gasket portion 17 in the peripheral area, which performs the sealing function, and an inside fitting portion 18 that serves for the fitting function. The thick main gasket portion 17 is provided with a major sealing ridge 19 of a large size underneath and a minor sealing ridge 20 on the top. The fitting portion 18 is slightly thinner than the main portion 17 and is in the shape of a simple, flat disc.

Figure 2:
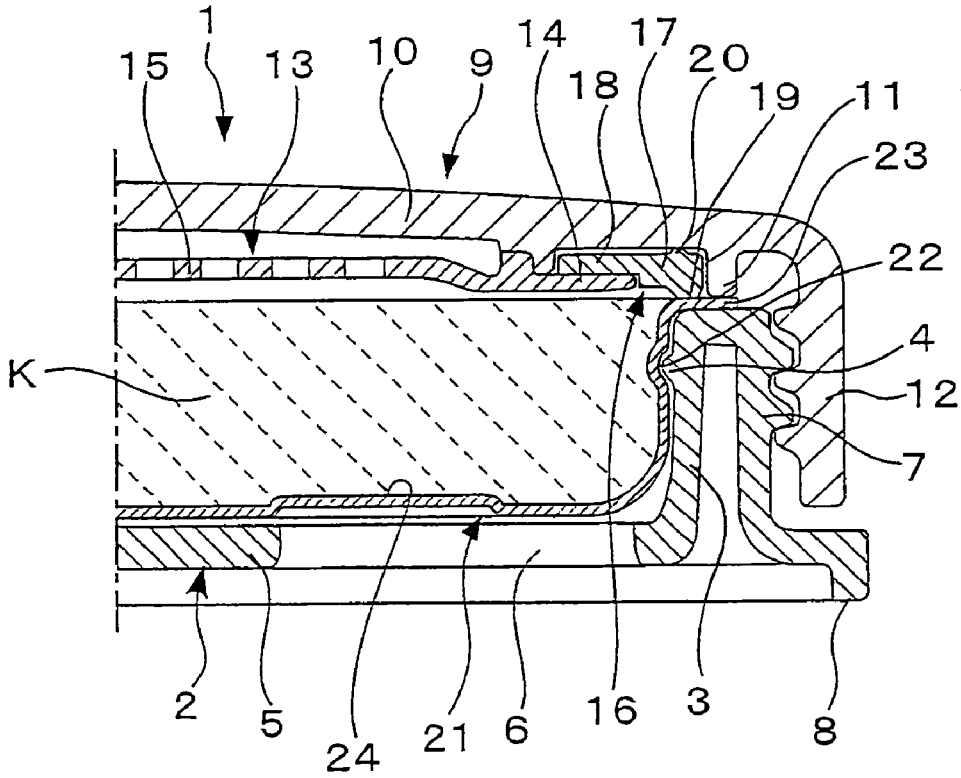
FIG. 2 is a partial enlarged view of an important section of the assembled refill case in the embodiment of FIG. 1.
Figure 3:
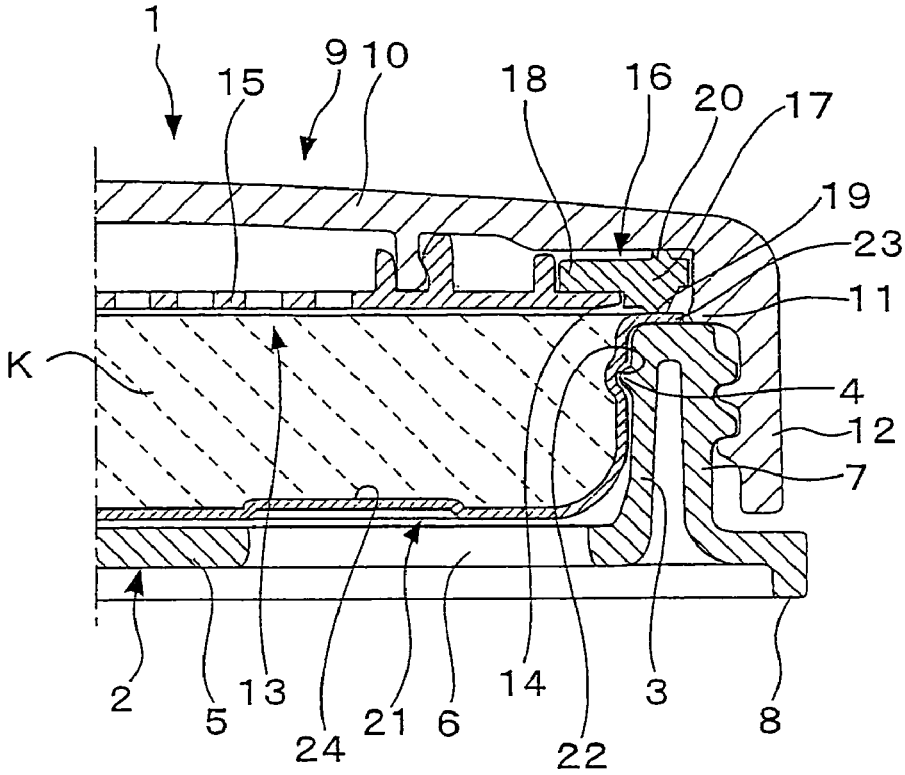
FIG. 3 is a partial enlarged view of an important section of the assembled refill case in another embodiment of this invention.

Although the gasket 16 is fitted to the cap 9 in the state having play in the radial direction, there is a limit to the range of this play in the radial direction. In FIG. 2, the play is limited by the butting wall 11 disposed outside of the gasket 16 and also by a low wall disposed inside of the gasket 16 to fit the gland 13. In FIG. 3, the play is limited by the butting wall 11 disposed outside of the gasket 16 and also by a wall of the gland 13 disposed inside of the gasket 16.

Thus, the gasket 16 is fitted to the cap 9 in the state having play in the radial direction, with the entire fitting portion 18 being sandwiched between the roof 10 and the support 14. As a result, the gasket 16 is embraced by the roof 10, and is capable of shifting its position in both the circumferential and radial directions.

The butting wall 11 in the embodiment shown in FIG. 2 is designed to set the position of screw engagement of the cap 9 with the case body 2, which is complete when the butting wall 11 butts against the brim 23 of the middle plate 21 to be put and kept in the case body 2. At that position, the gasket 16, too, comes in soft and yet tight contact with the brim 23. When the cap 9 is screwed on the case body 2, going down to the position where the screw engagement is complete, the gasket 16 is in soft contact with the brim 23 always at a constant force, with no regard to the difference in the state of fitting of the middle plate 21 to the case body 2, such as, for example, a difference in the height of the brim 23 as measured from the top flat rim of the case body 2.

Next, FIG. 3 shows the butting wall 11 in another embodiment. This butting wall 11 does not butt against the brim 23, but directly butts against the top flat rim of the case body 2. In this case, the cap 9 is screwed on the case body 2 in a firm and stable manner.

In order to remove the middle plate 21 from the refill case 1, at first the user should screw off the cap 9 from the case body 2, and then insert a finger tip through the window hole 6 to push up the middle plate 21 and to release the lock between the locking ridge segments 4 and the locking groove 22.

Since the window hole 6 is located near the periphery, the force of the finger to push up the middle plate 21 concentrates on a point close to where the locking ridge segments 4 are engaged with the locking groove 22. Thus, the middle plate 21 can be taken out easily and reliably with a hand.

A raised ring 24 to prevent the cosmetic from slippage is disposed on the bottom of the middle plate 21 and is aimed at stabilizing the immobile storage of the cosmetic K inside the middle plate 21.

The invention claimed is:

1. A refill case comprising:

a middle plate having a shape of a bottomed short cylinder containing a cosmetic item, the middle plate having an outward brim along an upper periphery of the plate;

a case body, which accepts and keeps the middle plate in a storage cylinder under the condition that the brim sits on a top flat rim of the storage cylinder; and a cap, which is fitted around said the case body detachably in screw engagement, and which is used to seal the middle plate through tight contact of the brim with a ring-shaped gasket made of a soft, elastic material, the gasket being embraced by an underside of a roof and fitted thereto in an undetachable manner but in a state having play relative to the roof, wherein the gasket includes a ring-shaped main gasket portion, which elastically comes in tight contact with the brim and a ring-shaped fitting portion, the ring-shaped fitting portion being disposed on an inward side of the main gasket portion and used for fitting to the cap, wherein the gasket is fitted to the cap in an undetachable manner but in a state having play relative to the roof, while the fitting portion is disposed between the roof and a gland, the gland being fixed to the roof, and wherein a butting wall is disposed on either one of the case body or the cap so as to butt against the other one at a position in which screw engagement of the cap with the case body is complete and in which soft contact deformation of the gasket is controlled within a range of elastic deformation.

2. The refill case according to claim 1, wherein rubber is used as a soft, elastic material for molding the gasket.

3. The refill case according to claim 1, wherein the case body has a double wall structure in which a storage cylinder is folded at the top flat rim to form an outward screw cylinder, which is used for the screw engagement with the cap, and wherein a foot portion is disposed at the lower end of the screw cylinder.

4. The refill case according to claim 1, wherein the butting wall hangs down from underside of the roof and butts against the top surface of the brim of the middle plate, which is stored and held in the case body.

5. The refill case according to claim 1, wherein the butting wall butts against the top flat rim of the case body.

6. The refill case according to claim 2, wherein the case body has a double wall structure in which a storage cylinder is folded at the top flat rim to form an outward screw cylinder, which is used for the screw engagement with the cap, and wherein a foot portion is disposed at the lower end of the screw cylinder.

7. The refill case according to claim 2, wherein the butting wall hangs down from underside of the roof and butts against the top surface of the brim of the middle plate, which is stored and held in the case body.

8. The refill case according to claim 3, wherein the butting wall hangs down from underside of the roof and butts against the top surface of the brim of the middle plate, which is stored and held in the case body.

9. The refill case according to claim 2, wherein the butting wall butts against the top flat rim of the case body.

10. The refill case according to claim 3, wherein the butting wall butts against the top flat rim of the case body.

* * * * *

UNITED STATES PATENT AND TRADEMARK OFFICE

CERTIFICATE OF CORRECTION

PATENT NO. : 7,451,877 B2
APPLICATION NO. : 10/549516
DATED : November 18, 2008
INVENTOR(S) : Tadayasu Koga, Chiaki Kamimura and Tsugio Arai It is certified that error appears in the above-identified patent and that said Letters Patent is hereby corrected as shown below:

Column 7,
Line 28, delete “said”.

Signed and Sealed this

Seventeenth Day of February, 2009

JOHN DOLL
*Acting Director of the United States Patent and Trademark Office*